United States Patent [19]

Mills

[11] Patent Number: 4,467,850

[45] Date of Patent: Aug. 28, 1984

[54] MACHINE FOR CUTTING ROUNDED CORNER NOTCHES

[76] Inventor: Thomas O. Mills, 219 N. Maple, Douglass, Kans. 67039

[21] Appl. No.: 355,987

[22] Filed: Mar. 8, 1982

[51] Int. Cl.[3] ..... B27C 5/00

[52] U.S. Cl. ..... 144/368; 83/425.3; 83/435.2; 144/3 R; 144/204; 144/136 R

[58] Field of Search ..... 144/2 R, 3 R, 1 R, 133 R, 144/189, 368, 204, 367; 83/425.2, 425.3, 435.2, 878

[56] References Cited

U.S. PATENT DOCUMENTS

| | | | |
|---|---|---|---|
| 134,588 | 1/1873 | Brunjes | 144/189 |
| 513,572 | 1/1894 | Hall | 144/368 |
| 691,428 | 1/1902 | Whurmann | 144/189 |
| 726,673 | 4/1903 | Goethe | 144/189 |
| 784,409 | 3/1905 | Litz | 144/189 |
| 3,470,924 | 10/1969 | Shorat | 144/133 R |
| 3,664,394 | 5/1972 | Wells | 144/133 R |
| 3,735,787 | 5/1973 | Siel | 144/133 R |
| 4,132,253 | 1/1979 | Mills | 144/133 R |

*Primary Examiner*—W. D. Bray

*Attorney, Agent, or Firm*—Edward L. Brown, Sr.

[57] ABSTRACT

A machine and method for cutting notches with rounded inner corners in wood pallets. The completed notches are made in one pass through the machine as the pallet passes over three successive stages of cutting. The first stage makes six vertical cuts for each notch, the inner four cuts to the depth of the notch and the outer cuts decreased in depth by the radius of the rounded corner and the outer cut being laterally separated from the adjacent deeper cut by a distance also equal to the radius of the rounded corner. The second stage, with a horizontal cut removes the wood between the inner four cuts and the third stage cuts out the rounded corner with a horizontally positioned radius cutter.

7 Claims, 9 Drawing Figures

MACHINE FOR CUTTING ROUNDED CORNER NOTCHES

CROSS REFERENCE TO RELATED APPLICATIONS

The applicant has a related application filed Feb. 25, 1980, Ser. No. 124,269, entitled: Method for Notching Pallets, U.S. Pat. No. 4,319,931.

BACKGROUND OF THE INVENTION

1. Field of the Invention

The present invention is an improvement of the applicant's previously patented inventions, U.S. Pat. No. 4,132,253 and U.S. Pat. No. 4,319,931. All are in the field of woodworking machines and methods, particularly in the field of gaining pallet stringers. The gaining operation, herein called notching, is done to permit the fork of a lift truck to pick up a pallet when the fork is normal to the stringers as well as when it is parallel. The present invention's improvement makes it possible to produce rounded corner notches in the same time now required for sharp-cornered notches and at a savings in energy requirements compared with present machines. The rounded corner notch is one with fillets on interior corners. A fillet is defined as a concave junction formed where two surfaces meet and is called a rounded corner herein.

2. Description of the Prior Art

The closest prior art known to the applicant are his U.S. Pat. No. 4,132,253 and U.S. Pat. No. 4,319,931. The patent is for a machine to cut notches in pallet stringers comprising, like the present invention, a base frame, a conveyor means for supporting and driving the stringers through the machine, a first cutting means for making at least four vertical cuts in each stringer, a second cutting means for for making a horizontal cut at top ends of the vertical cuts so positioned that a portion of the stringer between innermost vertical cuts is first cut away allowing arbor of the second cutting means to pass through the stringer while cutting away remaining portions between outermost vertical cuts. This machine makes no provision for producing a rounded corner.

The applicant's U.S. Pat. No. 4,319,931 is for a method for notching the stringers of an assembled pallet. Likewise it makes no provision for producing a rounded corner.

Earlier art includes U.S. Pat. No. 134,588, Brunjes and Benneckendorf, showing a machine for cutting a large piece of sugar into small blocks by using a gang of circular saws to cut a grid of grooves in the block and a cutoff saw at right angles to previous cuts to produce the small blocks. This machine is not capable of removing a block from an object while leaving the remainder of the object.

Goethe's U.S. Pat. No. 726,673 has gangs of vertical saw blades that cut notches not any wider than the saw blade thickness and reduce all removed material to sawdust.

Litz's U.S. Pat. No. 784,409 has gangs of vertical saw blades and a horizontal cutoff blade but is limited to producing blocks and cannot produce notches.

Weigand's U.S. Pat. No. 1,098,465 shows a mitering machine that cuts a mitered notch in a workpiece 24 after a mortise has been cut. The mortise 40 makes possible the passage, in steps, of an arbor 9 of a horizontal saw 10 through the workpiece 24. This machine will not make the notches required on pallet stringers because the mortise would weaken the stringer and the miter cuts would take up too much room on the underside of the pallet. This patent makes no provision for a rounded corner notch.

A machine now used for cutting notches with rounded corners in pallet stringers is shown in Short's U.S. Pat. No. 3,470,924. The circular cutting head 65 cuts out the entire notch by reducing it to sawdust. This takes more energy and time than the applicant's invention.

Well's U.S. Pat. No. 3,664,394 and Siel's U.S. Pat. No. 3,735,787 both have a group of adjoining cutters capable of cutting a rounded notch in pallet stringers by cutting all removed wood into sawdust and chips. These two machines do not have the energy-saving and time-saving capabilities of the applicant's invention, nor its useful waste product. Short, Wells, and Seil illustrate various ways of making a rounded corner notch.

The present state of the art does not include machines, other than experimental ones based on the applicant's invention, that will cut a rounded corner notch in pallet stringers using considerably less energy and time than the described prior art of Short, Wells, and Seil and produce a waste product remainder that is about eighty percent wood blocks. The wood blocks are more valuable than sawdust which comprises one hundred percent of the waste product remainder of prior art machines and methods. The term sawdust in this specification includes wood chips.

BRIEF SUMMARY OF THE INVENTION

The present invention produces a rounded corner rather than a sharp-pointed inside notch in pallet stringers. It uses smaller motors, also less energy and time than present machines and and methods. It produces a wood by-product of blocks instead of sawdust. This conserves energy, time, and wood. The rounded corner notch is made principally by regular circular saw cuts leaving only a quadrant to be removed by a radius cutter. The quadrant amounts to about three percent of the total notch.

The savings in cost of the machine, in energy, and in time is due to not cutting up all of the removed wood into sawdust.

Energy requirements are reduced to about one-half that of present machines because the cutting operation is reduced to grinding up about 15 percent instead of 100 percent of the wood removed from the rounded corner notch. Present machines and methods grind up the entire notch into sawdust and wood chips when making a rounded corner notch. The present invention reduces this task resulting in smaller horsepower motors for cutting notches, less energy to run them, and faster cutting which reduces labor and number of machines required. The waste product is about 80 percent wood blocks. The blocks are salable while sawdust usually is not.

The principal object of this invention is to reduce time and energy costs needed to cut the rounded corner notch in pallet stringers by cutting into sawdust a smaller percentage of wood.

Another object is to increase production capacity of the machine capable of cutting the rounded corner notch while actually using less energy.

Another object is to reduce cost of cutting the rounded corner notch by increasing the value of the waste product remainder.

BRIEF DESCRIPTION OF THE DRAWING

The details and objects of the present invention will become apparent from a reading of the specification and claims together with the accompanying drawing which sets forth a preferred embodiment of the invention.

DESCRIPTION OF THE PREFERRED EMBODIMENT

Figure 1:
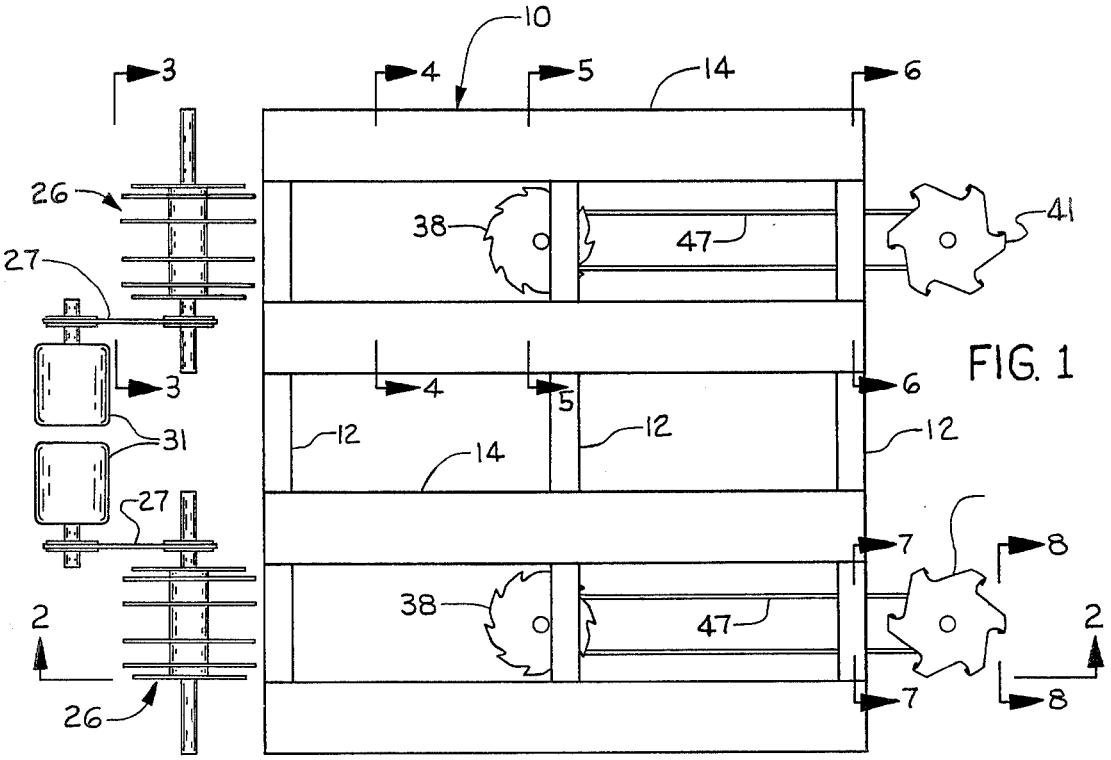
FIG. 1 is a plan view looking down on a pallet workpiece and three stages of cutting devices of this machine, omitting base frame and conveyor means which are well-known in the art.
Figure 2:
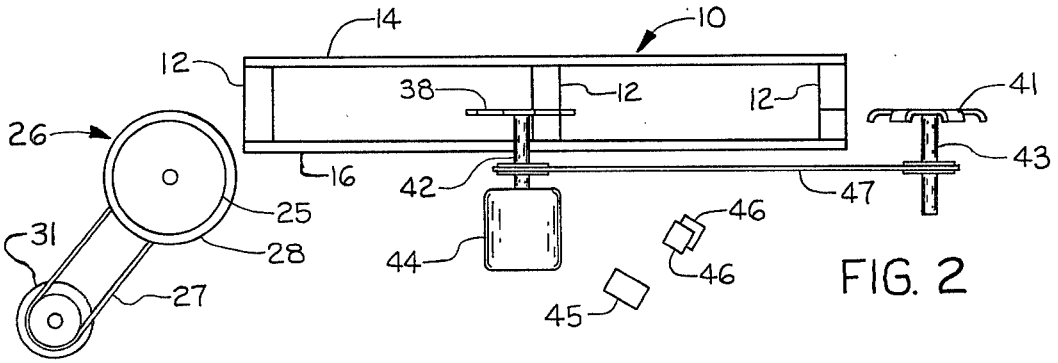
FIG. 2 is sectional view of pallet and three stages of cutting devices, taken along line 2—2 of FIG. 1.

Referring to FIGS. 1 and 2, the machine comprises a base frame and a powered conveyor means, neither of which are shown being well known in the art and exemplified in FIG. 1 of the applicant's U.S. Pat. No. 4,132,253.

Figure 3:
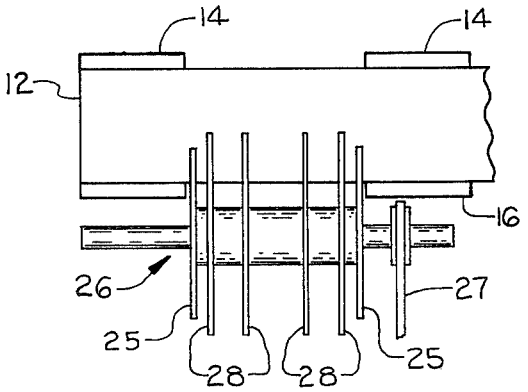
FIG. 3 is an enlarged sectional taken along line 3—3 of FIG. 1 showing a first stage cutting device and a notch portion of the pallet passing over the device.
Figure 7:
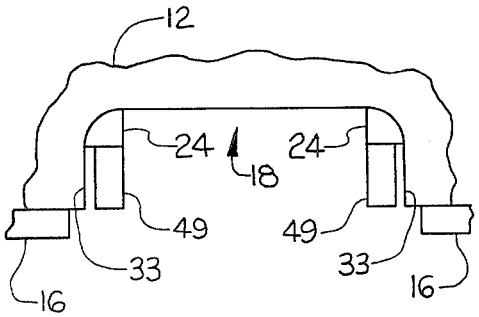
FIG. 7 is a further enlarged sectional view taken along line 7—7 of FIG. 1 of the notch portion approaching the third stage cutting device.

A pallet 10 is driven through the machine by the conveyor means. The workpiece seen in FIGS. 1 and 2 is the pallet 10 but can be a stringer 12 or a group of stringers 12. A first stage cutting means 26 is a gang of vertical saw blades rotatably mounted on the base frame. The first stage cutting means 26 is driven by a belt 27 from a motor 31 and includes a group of adjacent saw blades 28 and a pair of outside saw blades 25 as best seen in FIG. 3. A pair of quadrants 24 seen in FIG. 7 is the material that later is to be removed to form a pair of fillets 20 providing the rounded corners. The radius of the fillets 20 determines the lateral spacing between the outside blades 25 and the adjacent blades 28; it also determines the difference in radius between the outside blades 25 and the adjacent blades 28.

Figure 4:
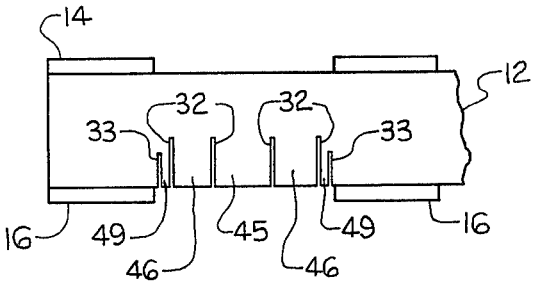
FIG. 4 is an enlarged sectional view taken along line 4—4 of FIG. 1 of the notch portion with its vertical saw cuts when it is between the first and a second stage cutting devices.
Figure 5:
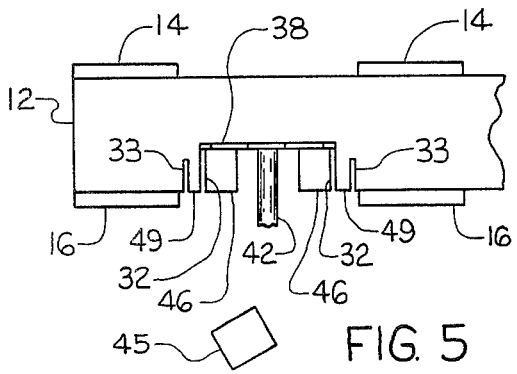
FIG. 5 is an enlarged sectional view taken along line 5—5 of FIG. 1 of the notch portion at the second stage cutting device.
Figure 6:
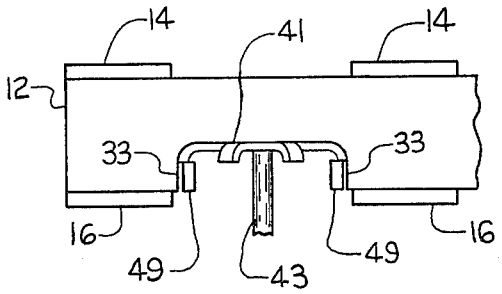
FIG. 6 is an enlarged sectional view taken along line 6—6 of FIG. 1 of the notch portion passing a third stage cutting device.

In FIG. 4 can be seen a group of deeper vertical cuts 32 made by the adjacent blades 28 and a pair of shorter vertical cuts 33 made by the outside blades 25. This is the condition of a notch area of the stringer 12 after passing the first stage cutting means 26. A central notch section 45, at least a pair of intermediate notch sections 46, and a pair of outside notch sections 49 are located between the shorter vertical cuts 33.

A second stage cutting means includes a horizontally positioned saw blade 38 with a downwardly extending arbor 42 driven by a motor 44. The saw blade 38 cuts off successively, the central notch section 45 and the intermediate notch sections 46. The diameter of the horizontally positioned blade 38 is equal to the distance between the outermost of the group of adjacent saw blades 28 and it is set vertically to cut at the end of the deeper vertical cuts 32. After passing the second stage cutting means the notch 18 area appears as seen in FIG. 7 with the outside notch sections 49 remaining attached to the stringer 12 by the quadrants 24. The adjacent blades 28 may be uniformly sized laterally so that the notch sections 45 and 46 are uniformly sized.

Figure 9:
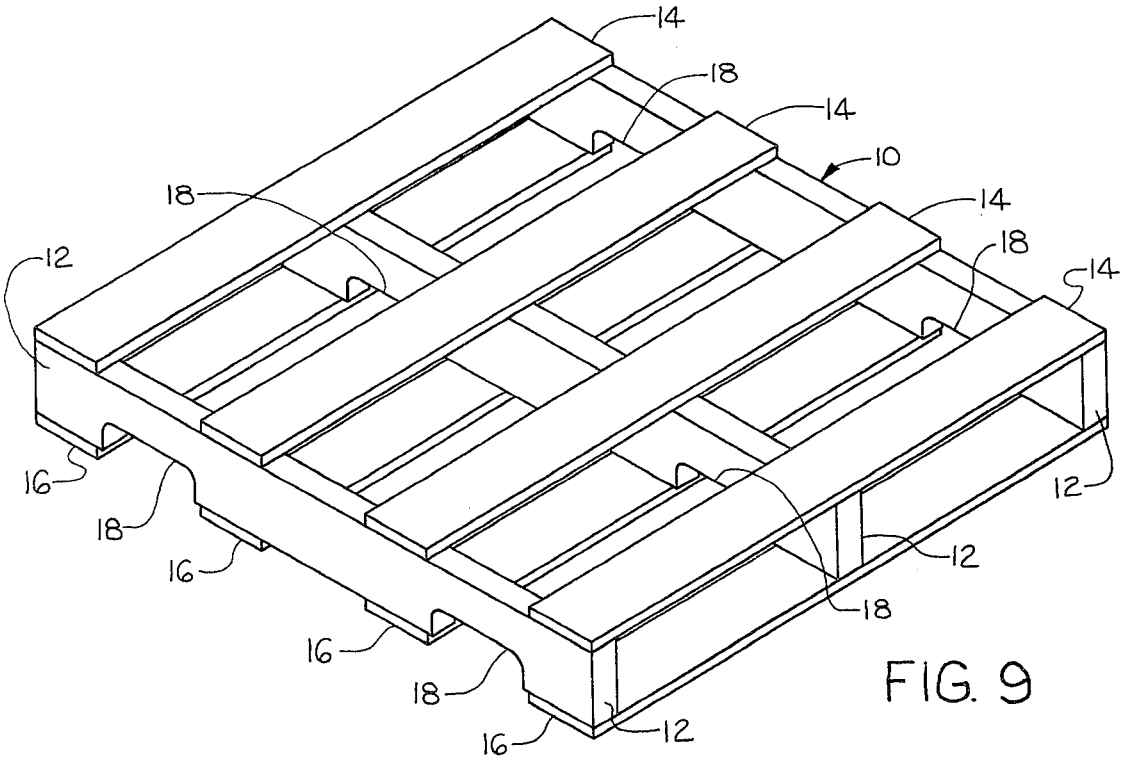
FIG. 9 is an isometric view of the finished pallet workpiece showing the rounded corner notches.

The typical wood pallet 10 is shown in FIG. 9 with a plurality of top slats 14 and bottom slats 16 normal to and fastened to the stringers 12. The bottom of the stringers 12 have a pair of the rounded corner notches 18 permitting a lift truck fork to be entered from the lower left or upper right as well as from the directions parallel to the stringers 12.

Figure 8:
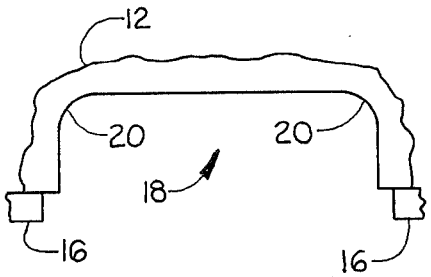
FIG. 8 is a further enlarged sectional view taken along line 8—8 of FIG. 1 of the notch portion showing the rounded corner notch after passing the third stage cutting device.

A third stage cutting means includes a horizontally positioned radius cutter 41 with a downwardly extending arbor 43 driven by a belt 47 connected with the arbor 42. The radius cutter 41 cuts out the quadrants 24 thus forming the fillets 20 and cutting free the outside notch sections 49. The radius cutter 41 has an outside diameter equal to the distance from the outside blade 25 at one side of the notch 18 to the outside blade 25 at the other side of the notch 18. The radius cutter 41 is set vertically so that the cut made by the second stage cutting means, blade 38, is tangent to the radius cutter 41. As best seen in FIG. 8, the rounded corner notch 18 is complete after going through the first, second, and third stage cutting means, 26, 38, and 41 respectively.

The preferred embodiment comprises two sets of the three stages of cutting means, 26, 38, and 41 so that two of the notches 18 can be cut at the same time.

In summary, the savings are in the cost of the machine, the energy to operate it, the operating time, and in producing a waste that is more marketable. The lower costs are basically due to not cutting all the waste into sawdust.

OPERATION

The preferred mode of operation is to cut a pair of rounded corner notches 18 in a plurality of stringers 12 of an assembled pallet 10. A description of the making of one of the pair of the notches 18 follows with the understanding that the other notch is being made at the same time.

Referring to FIGS. 1 and 2 the pallet 10 is moved from left to right past a first cutting means 26 where a pair of outside blades 25 cuts a pair of vertical cuts 33 to form the straight portion at each side of the notch 18 and a group of four adjacent blades 28, equally spaced, cuts a group of vertical cuts 32 as deep as the full depth of the notch 18 and extending from a quadrant 24, seen in FIG. 7, at one side of the notch 18 to the quadrant 24 at the other side of the notch 18.

The pallet 10 is kept moving to the right past a second stage cutting means including a horizontally positioned saw blade 38 which cuts out the central area of the notch 18 between the outermost adjacent blades 28, cutting free a central notch section 45 and a pair of intermediate notch sections 46.

The pallet 10 is kept moving to the right past a third stage cutting means including a horizontally positioned radius cutter 41 which cuts out the pair of quadrants 24 at the inside corners of the notch 18 forming a pair of fillets 20 which rounds out the corners between the sides and top of the notch 18. Cutting out the pair of quadrants 24 also cuts free a pair of outside notch sections 49.

While the leading stringer 12 is moving past the various stages, the following stringers 12 are being cut progressively in similar fashion.

Having described the invention with sufficient clarity and completeness to enable those skilled in the art to make and use the invention and having set forth the best mode contemplated by the inventor for carrying out his invention,

I claim:

1. A machine for cutting a rounded corner in a pallet stringer notch comprising:

a first stage cutting means including at least two vertically positioned, laterally spaced saw blades, an outside blade having a shorter radius than an adjacent blade by a distance substantially equal to the lateral spacing between said two blades; and a second stage cutting means following the first stage cutting means and including a horizontally positioned saw blade, with a downwardly extending arbor, positioned to intersect the end of the cut of said adjacent blade and cut away a portion of the stringer notch; and a third stage cutting means following the second stage cutting means and including a horizontally positioned radius cutter, with a downwardly extending arbor, positioned to intersect the end of the vertical cut of the adjacent blade perpendicularly and intersect the end of the vertical cut of the outside blade tangentially to form the rounded corner of the stringer notch.

2. A machine for cutting a rounded corner in a pallet stringer notch as set forth in claim 1, wherein there are two outside blades and four equally transversely spaced adjacent blades between the outside blades.

3. A machine for cutting a rounded corner in a pallet stringer notch as set forth in claim 1, wherein two of the rounded corner notches are cut at the same time in the pallet stringer by two sets of the first, second, and third stage cutting means.

4. A machine for cutting a rounded corner in a pallet stringer notch as set forth in claim 1, wherein the cutting means are arranged as follows: the first stage cutting means cuts a leading stringer; then while the second stage cutting means is cutting the leading stringer, the first stage cutting means is cutting a following stringer; then while the third stage cutting means is cutting the leading stringer and the second stage cutting means is cutting the following stringer, the first stage cutting means is cutting a second following stringer.

5. A method for forming a notch with rounded corners in a pallet stringer comprising the steps of:

(a) making a pair of outside vertical cuts, one at each side of the notch, to a depth substantially equal to the depth of the notch less the rounded corner's radius; making an adjacent vertical cut inside each of the pair of outside vertical cuts, spaced a lateral distance substantially equal to said radius from the outside cuts, and to a depth substantially equal to the depth of the notch; and making two additional adjacent vertical cuts to the depth of the notch and laterally spaced approximately equidistantly between the first-mentioned two adjacent vertical cuts;

(b) then making a horizontal cut connecting ends of the two first-mentioned adjacent vertical cuts; and (c) then making a radius cut forming the rounded corners of the notch, tangential to and connecting ends of the horizontal cut with ends of the pair of outside vertical cuts.

6. A method for forming a notch with rounded corners in a pallet stringer as set forth in claim 5, wherein two of the notches with rounded corners are cut in the stringer at the same time.

7. A method for forming a notch with rounded corners in a pallet stringer as set forth in claim 5, wherein the stringer has been assembled into the pallet beforehand.

* * * * *